United States Patent [19]

Miyasaka et al.

[11] 4,198,809

[45] Apr. 22, 1980

[54] CONSTRUCTION OF AN ANALOGUE CRYSTAL WRIST WATCH

[75] Inventors: Kenzi Miyasaka, Tokyo; Ryo Namiki, Kawagoe; Kotaro Takahashi, Sayama, all of Japan

[73] Assignee: Citizen Watch Co., Ltd., Tokyo, Japan

[21] Appl. No.: 907,488

[22] Filed: May 19, 1978

[30] Foreign Application Priority Data

May 28, 1977 [JP] Japan ..... 52-62564

[51] Int. Cl.[2] ..... G04C 3/00; G04B 27/02

[52] U.S. Cl. ..... 368/80; 368/88; 368/204; 368/160

[58] Field of Search ..... 58/4 R, 4 A, 23 R, 23 BA, 58/23 D, 23 AC, 33, 46 R, 52 R, 53, 57, 58, 63, 73, 85.5, 88 R, 88 B, 90 B, 99

[56] References Cited

U.S. PATENT DOCUMENTS

| | | | |
|---|---|---|---|
| 3,604,202 | 9/1971 | Besson | 58/23 R |
| 3,676,993 | 7/1972 | Bergey et al. | 58/23 R |
| 3,691,753 | 9/1972 | Kurita | 58/23 R |
| 3,745,758 | 7/1973 | Kuritz | 58/23 A |
| 3,842,585 | 10/1974 | Lupoci | 58/23 R |
| 3,875,738 | 4/1975 | Ichikawa et al. | 58/57.5 |
| 3,945,190 | 3/1976 | Kimura et al. | 58/4 A |
| 4,087,957 | 5/1978 | Miyasaka et al. | 58/23 R |

*Primary Examiner*—Vit W. Miska

*Attorney, Agent, or Firm*—Sherman & Shalloway

[57] ABSTRACT

The construction of an analogue crystal wrist watch which comprises a base plate, a power source battery cell on said base plate for providing energy to the circuit of said watch, a crystal oscillating element for generating a signal upon receipt of energy, an electronic circuit for dividing the frequency of the output signal from said crystal oscillating element, a frequency division circuit included in said electronic circuit, a step motor comprising a drive coil connected to said electronic circuit, a hand indication means driven by said step motor, an external operation member for correcting said hand indication means and a reset lever interlocked with said external operation member for resetting said electronic circuit.

13 Claims, 4 Drawing Figures

CONSTRUCTION OF AN ANALOGUE CRYSTAL WRIST WATCH

BACKGROUND OF THE INVENTION

This invention relates to the construction of the movement of an ultra-small type analogue crystal wrist watch.

With rapid popularization of high precision analogue wrist watches of late, demands for smaller and thinner analogue wrist watches are increasing. However, since the battery cell, crystal oscillating element and step motor which constitute principal components of the analogue crystal wrist watch occupy a relatively large space both in horizontal and vertical directions, respectively, it is not possible to dispose these components on other respectively associated wrist watch components. For the reason, in order to reduce the thickness of the movement of an analogue crystal wrist watch, separate spaces for accommodating the battery cell and crystal oscillating element and the drive coil constituting the step motor should be provided in the movement so that these components can be disposed not to overlap one upon another in the movement and the movement also requires other spaces for accommodating other timepiece components which inevitably increases the size of the timepiece and makes it impossible to realize an ultra-small type timepiece. Thus, an ultra-small type thin analogue crystal wrist watch such as a woman's bracelet watch has been difficult to be produced up to date.

SUMMARY OF THE INVENTION

Therefore, the purpose of the present invention is to make it possible to realize an ultra-small type analogue crystal wrist watch by disposing the crystal oscillating element, the reset lever interlocked with the stem and the reset lever holder adapted to regulate the clearances above and below the reset lever in different heights in the same space to thereby realize an ultra-small type analogue crystal wrist watch.

In order to attain the above purpose, according to the present invention, the battery cell, crystal oscillating element and drive coil which constitute principal components of the movement are disposed in different horizontal spaces along and inwardly of the periphery of the movement, the wheel train of the hand indicating means is positioned in the center of the movement and the crystal oscillating element and the reset lever adapted to be interlocked with the stem constituting the hand correction means for resetting the frequency division circuit are disposed in different heights in the common horizontal space.

According to the present invention, there has been provided an analogue crystal wrist watch which essentially comprises a base plate, a power source battery cell provided on said base plate for providing energy to the watch circuit of said wrist watch, a crystal oscillating element adapted to receive energy from said power source battery cell and generate a signal of a predetermined frequency, an electronic circuit for dividing the frequency of the output signal of said crystal oscillating element, a step motor comprising a drive coil connected to said electronic circuit, a hand indication means driven by said step motor, an external operation member constituting a hand correction means for correcting said hand indication means, a reset lever interlocked with said external operation member to reset said electronic circuit, said crystal oscillating element and reset lever being disposed in the same horizontal space and said base plate having an oval shape as seen in plan.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

PREFERRED EMBODIMENT OF THE INVENTION

Figure 1:
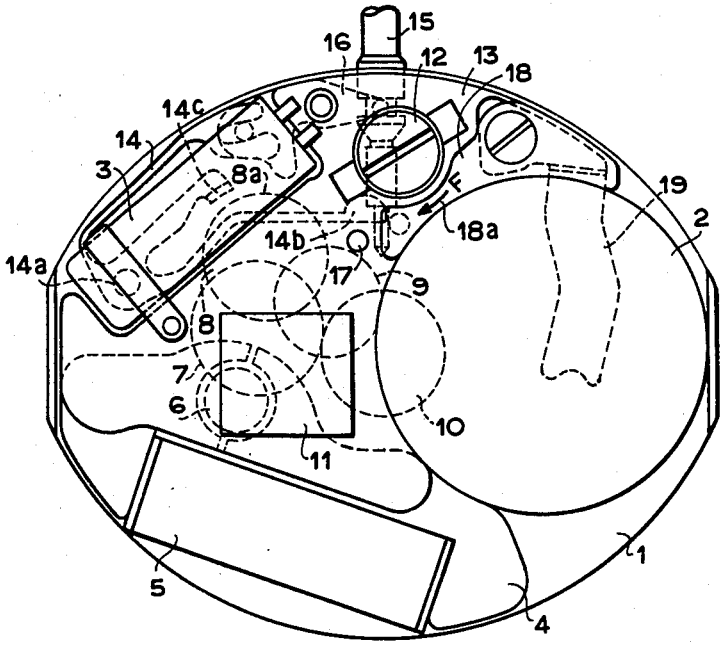
FIG. 1 is a plan view of the movement of one embodiment of analogue crystal wrist watch of the present invention.

The present invention will be now described referring to the accompanying drawings which show one preferred embodiment of the analogue crystal wrist watch of the invention. First referring to FIG. 1 of the accompanying drawings, reference numeral 1 denotes the movement base plate which has an oval shape most suitable for a woman's bracelet watch and a battery cell 2, a crystal oscillating element 3, a stator 4 and a drive coil 5 are disposed along and inwardly of the periphery of the base plate 1. The stator 4 and drive coil 5 constitute a step motor. Provided in the center of the movement are a fifth wheel - pinion 7, a fourth wheel - pinion 8, a eighth wheel - pinion 9 and a center wheel 10 of a hand indication means driven by the rotor 6 of the step motor. These wheel - pinions and wheel are the principal components of the hand indication means. Disposed in the space defined by the battery cell 2, crystal oscillating element 3 and drive coil 5 above the wheel train is a printed circuit board 13 on which electronic circuit elements such as a circuit 11 and a trimmer capacitor 12 are mounted. A reset lever 14 is disposed below the crystal oscillating element 3. The reset lever 14 is rotated in the clockwise direction about the rotary shaft **14*a* through a setting lever 16 by pulling a stem 15 until the contact 14*b* of the reset lever 14 comes into contact with a reset pin 17 secured to the printed circuit board 13. Furthermore, the reset pin 17 is connected to the reset terminal of the electronic circuit 11 by means of a pattern wiring (not shown). And the positive pole of the battery cell 2 is grounded to the base plate 1 and the base plate 1 and reset lever 14 are in electrically continuity. That is, in the normal position of the stem 15, the reset terminal of the circuit 11 is open and the reset lever 14 comes into contact with the reset pin 17 by pulling (not shown) the stem 15 whereby the reset switch constituted by the reset lever 14 and reset pin 17 turns ON and is electrically connected to the reset terminal VDD of the electronic circuit 11. As a result, the frequency division circuit within the circuit 11 is reset and no drive current flows through the drive coil which is "the economy in power consumption condition". When the stem 15 is moved from its normal position to the pulled position in which the stem aligns with one of the hands, the reset lever 14 abuts against the addendum 8***a* on the fourth wheel - pinion 8 by means of the brake portion 14*c* of the reset lever 14 to thereby lock the fourth wheel - pinion 8 in position. Reference numeral 18 denotes the battery cell support 18 which positions the battery 2 in horizon. The upper surface of the battery cell support 18 is provided with a fast and slow adjustment indication mark 18*a* to use the space effectively. Reference numeral 19 denotes the cathode supporting spring for the battery cell 2.

Figure 2:
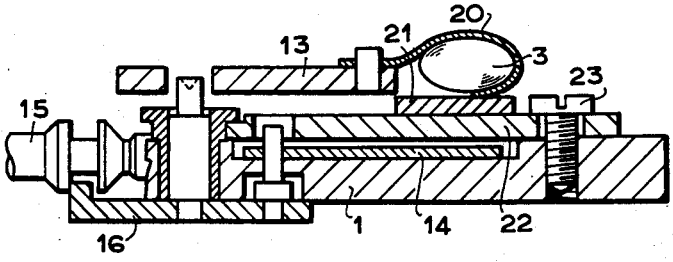
FIG. 2 is a fragmentary vertically sectional view of said movement as shown in FIG. 1.

FIG. 2 is a fragmentary vertically sectional view of the area containing the crystal oscillating element 3 and reset lever 14. The crystal oscillating element 3 has an oval cross-sectional shape to minimize the area to be occupied by the crystal oscillating element. The crystal oscillating element 3 is resiliently supported by a crystal oscillating element supporting spring 20 secured to the printed circuit board 13 and has a crystal oscillating support element 21 attached to the undersurface which is formed of soft shock absorption material such as silicone rubber in order to increase shock absorption ability of the crystal oscillating element 3. Furthermore, a plastic reset lever holder 22 and the reset lever 14 are disposed in spaced overlying relationship in the same space below the crystal oscillating element support 21. The reset lever 14 concurrently serves as the brake for the fourth wheel - pinion 8 in cooperation with the reset lever holder 22 when the stem 15 is aligned with one of the hands. Reference numeral 23 denotes a reset lever holding screw for securing the reset lever holder to the base plate 1.

Figure 3:
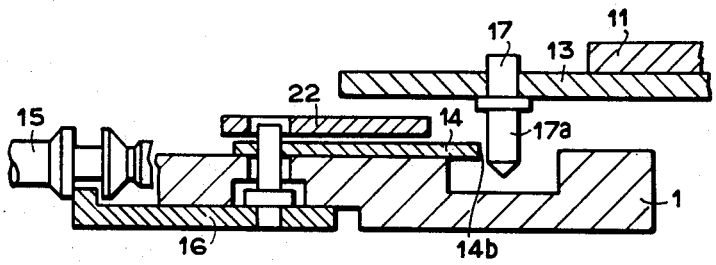
FIG. 3 is an exploded vertically sectional view of the reset switch of said movement as shown in FIG. 1.

FIG. 3 is a cross-sectional view of the reset switch of the movement of the present invention and by pulling the stem 15 in one or the other direction, the contact 14*b* of the reset lever 14 comes to contact with and disengages from the contact 17*a* of the reset pin 17.

Figure 4:
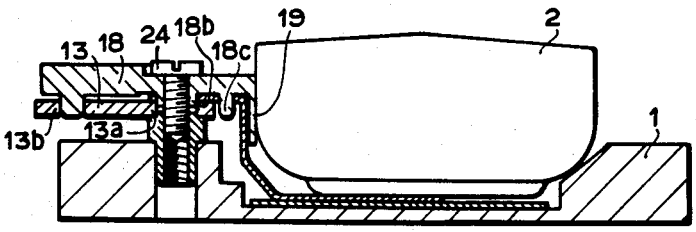
FIG. 4 is a vertically sectional view of the battery cell and its associated parts as shown in FIG. 3.

FIG. 4 is a vertically sectional view of the battery cell and its associated parts and the battery cell 2 is controlled in its horizontal position by the battery cell support 18 and the cathode supporting spring 20 is controlled in its horizontal position at two points by a boss 18*b* and a projection 18*c*, respectively. The battery cell support 18 is positioned on the printed circuit board 13 by means of holes 13*a* and 13*b*. Reference numeral 24 denotes a battery cell holding screw which secures the battery cell support 18 and cathode supporting spring 19 to the printed circuit board 13. Thus, the positions of the battery cell 2 and cathode supporting spring 19 are controlled by the battery cell support 18 and the connection between the cathode supporting spring 19 and the pattern wiring on the printed circuit board 13 is effected in a narrow space.

As mentioned hereinabove, according to the present invention, the reset lever which is interlocked with the stem, resets the frequency division circuit of the electronic circuit and includes the reset switch contact which is disposed in spaced overlapping relationship to the crystal oscillating element in the common plane and accordingly, the rotary shaft of the reset lever and the crystal oscillating element are disposed in different heights in the common plane.

Therefore, according to the present invention, in order to provide an ultra-small type and thin analogue crystal wrist watch such as a woman's bracelet watch, the movement has an oval shape as seen in plan and the crystal oscillating element constitutes one of the constituent components of the movement. The battery cell, crystal oscillating element and drive coil are distributed along and inwardly of the periphery of the base plate which has a shape most suitable for a small type timepiece, the wheel train of the hand indication means and electronic circuit elements are positioned in the space defined by the battery cell, crystal oscillating element and drive coil, the reset lever which has the contact adapted to make contact with the reset switch for resetting the frequency division circuit of the electronic circuit to the "economy in power consumption position" in cooperation with the stem of the hand correction means and setting lever is positioned right below the crystal oscillating element, and the braking action for prevention of the rotation of the rotor is obtained when the reset lever is aligned with one of the hands. Thus, the space exclusively used for the reset lever as required in the conventional timepiece can be eliminated and since the crystal oscillating element and reset lever can be provided in the common same space, the space can be fully utilized whereby the timepiece can be easily designed. And as to the thickness of the movement, since the printed circuit board is provided with the recess for receiving the crystal oscillating element, the thickness of the crystal oscillating element is made small as much as possible and the cross-sectional configuration of the crystal oscillating element is oval whereby the thickness of the movement will not increase even when the crystal oscillating element and reset lever are disposed one upon another in spaced relationship.

While one embodiment of the invention has been shown and described in detail, it will be understood that the same is for illustration purpose only and not to be taken as a definition of the invention, reference being had for this purpose to the appended claims.

What is claimed is:

1. The construction of an analogue crystal wrist watch comprising:

(a) a base plate, (b) a power source battery cell provided on said base plate for providing energy to the watch circuit of said wrist watch, (c) a crystal oscillating element adapted to receive energy from said power source battery cell and generate a signal of predetermined frequency, (d) an electronic circuit including a frequency division circuit for dividing the frequency of the output signal of said crystal oscillating element, (e) a step motor comprising a drive coil connected to said electronic circuit, (f) a hand indication means driven by said step motor, (g) an external operation member constituting a hand correction means for correcting said hand indication means, (h) a reset lever cooperating with said external operation member to reset said electronic circuit, (i) said crystal oscillating element disposed over said reset lever, and (j) said base plate having an oval shape as seen in plan.

2. The construction of an analogue crystal wrist watch as set forth in claim 1, in which said crystal oscillating element is of oval cross-section as seen in vertical section.

3. The construction of an analogue crystal wrist watch as set forth in claim 2, in which said crystal oscillating element is resiliently supported on a printed circuit board by a crystal oscillating element supporting spring and has a shock absorbent crystal oscillating element support secured to the undersurface thereof.

4. The construction of an analogue crystal wrist watch as set forth in claim 3, further including a reset lever holder provided between the leading end of said crystal oscillating element and said reset lever and having one end secured to said base plate by said reset lever and the other end urging said reset lever towards said base plate.

5. The construction of an analogue crystal wrist watch as set forth in claim 1, in which said power source battery cell, crystal oscillating element and drive coil are disposed at three different areas surrounding the wheel train of said hand indication means.

6. The construction of an analogue wrist watch as set forth in claim 1 wherein said crystal oscillating element and said electronic circuit are located in the same plane on the circuit substrate.

7. The construction of an analogue crystal wrist watch as set forth in claim 6 further including a wheel train located at the center of the base plate.

8. The construction of an analogue crystal wrist watch comprising:

(a) an oval-shaped base plate having a recess,
(b) a battery cell received in said recess in the base plate,
(c) a crystal oscillating element adapted to receive energy from said battery cell to generate a signal of predetermined frequency,
(d) an electronic circuit including a frequency division circuit for dividing the frequency of the output signal from said crystal oscillating element,
(e) a step motor comprising a drive coil connected to said electronic circuit, and
(f) a hand indication means having a wheel train to be driven by said step motor,
(g) said battery cell, crystal oscillating element and drive coil being disposed along and inwardly of the periphery of said base plate at the apices of a triangle surrounding said wheel train,
(h) an external operation member constituting a hand correction means for correcting said hand indication means,
(i) a reset lever cooperated with said external operation member for resetting said electronic circuit, and
(j) said crystal oscillating element disposed over said reset lever.

9. The structure of an analogue crystal wrist watch comprising:

(a) an oval-shaped base plate having a battery cell receiving recess arranged at one side circumference of said base plate in the longer diameter direction;
(b) a battery cell received in said battery cell receiving recess and substantially defining the full height of said structure;
(c) a hand indication means including a wheel train disposed on the center part of said base plate;
(d) a printed circuit board mounted on said hand indication means;
(e) a crystal oscillator element mounted in an opening of said printed circuit board at a circumference of said base plate opposite said battery cell and powered by said battery cell to generate a signal with the predetermined standard frequency;
(f) an electronic circuit including an oscillating circuit and a frequency division circuit dividing the output signal of said oscillating circuit, mounted on an upper side of said printed circuit board at the center portion of said base plate;
(g) a step motor mounted at a circumference of said base plate adjacent said battery cell and having a cored drive coil connected to said electronic circuit at an outer side of said base plate and a stator and a rotor at the inner side of said base plate;
(h) a setting stem mounted at the circumference of said base plate between said battery cell and said crystal oscillator and manually operated at the exterior thereof for resetting the hands of said hand indication means;
(i) a terminal projecting downwardly from said printed circuit board near said crystal oscillator element and being electrically connected to said circuit;
(j) a reset lever mounted on said base plate cooperating with said setting stem, said reset lever having two arms, one of which locks a wheel of said wheel train to stop said rotor when resetting the hands and the other arm contacting said terminal after resetting the hands to reset said dividing circuit;
(k) said battery cell, said crystal oscillator and said drive coil being disposed along and inward to the circumference of said base plate at the apices of a triangle surrounding said wheel train and said electronic circuit; and
(l) said crystal oscillator element superposed over said resetting lever as seen in plan.

10. The structure of an analogue crystal wrist watch as set forth in claim 9 in which said crystal oscillator element is of oval cross-section as seen in vertical section.

11. The structure of an analogue crystal wrist watch as set forth in claim 10 in which said crystal oscillator element is resiliently supported on a printed circuit board by a crystal oscillating element supporting spring and has a shock absorbent crystal oscillating element support secured to the undersurface thereof.

12. The structure of an analogue crystal wrist watch as set forth in claim 11, further including a reset lever holder provided between a leading end of said crystal oscillating element and said reset lever and having one end secured to said base plate by said reset lever and the other end urging said reset lever towards said base plate.

13. The structure of an analogue crystal wrist watch as set forth in claim 9, in which said power source battery cell, crystal oscillating element and drive coil are disposed at three different areas surrounding the wheel train of said hand indication means.

* * * * *